US007896824B2

(12) United States Patent
Gueret

(10) Patent No.: US 7,896,824 B2
(45) Date of Patent: Mar. 1, 2011

(54) MASSAGE DEVICE HAVING DEFORMABLE AND/OR MOVABLE BRANCHES AND MASSAGE METHOD USING SAME

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1103 days.

(21) Appl. No.: 11/546,367

(22) Filed: Oct. 12, 2006

(65) Prior Publication Data

US 2007/0083135 A1 Apr. 12, 2007

Related U.S. Application Data

(60) Provisional application No. 60/731,231, filed on Oct. 31, 2005.

(30) Foreign Application Priority Data

Oct. 12, 2005 (FR) ..... 05 53107

(51) Int. Cl.
*A61H 15/00* (2006.01)

(52) U.S. Cl. ..... 601/127; 601/120; 601/123; 601/125

(58) Field of Classification Search ..... 601/112, 601/113, 118, 119, 120, 122, 123, 125, 127, 601/128, 129, 131, 134, 135, 136, 137
See application file for complete search history.

(56) References Cited

U.S. PATENT DOCUMENTS

| | | | | |
|---|---|---|---|---|
| 1,915,190 | A | 6/1933 | Koment | |
| 2,691,978 | A | 10/1954 | Kirby | |
| 3,039,457 | A | 6/1962 | Boudkevitch et al. | |
| 5,218,955 | A | 6/1993 | Gueret | |
| 6,221,034 | B1 * | 4/2001 | Chaplin | 601/137 |
| 7,186,228 | B2 * | 3/2007 | Friedland | 601/72 |
| 2005/0020948 | A1 | 1/2005 | Gueret | |

FOREIGN PATENT DOCUMENTS

| | | | |
|---|---|---|---|
| AT | 4 1606 | | 3/1910 |
| AU | 2003229130 | B2 | 1/2004 |
| DE | 523 206 | C | 4/1931 |
| FR | 655.235 | | 4/1929 |
| FR | 1 335 549 | A | 8/1963 |
| FR | 2 282 855 | A | 3/1976 |
| GB | 169 217 | A | 9/1921 |
| GB | 261 902 | A | 12/1926 |

* cited by examiner

*Primary Examiner*—Quang D Thanh
(74) *Attorney, Agent, or Firm*—Oliff & Berridge, PLC

(57) ABSTRACT

A massage device may include: at least two massage members; and at least two branches. Each branch may carry at least one massage member. The branches may be in a first configuration when the massage members are not engaged with a region to be treated, and may be configured to take up a second configuration when the massage members are engaged with the region to be treated. The branches may be displaced relative to each other while passing from the first configuration to the second configuration, and may be configured to return resiliently into the first configuration when the massage members are no longer engaged with the region to be treated.

16 Claims, 8 Drawing Sheets

MASSAGE DEVICE HAVING DEFORMABLE AND/OR MOVABLE BRANCHES AND MASSAGE METHOD USING SAME

CROSS-REFERENCE TO RELATED APPLICATION

This non provisional application claims the benefit of French Application No. 05 53107 filed on Oct. 12, 2005 and U.S. Provisional Application No. 60/731,231 filed on Oct. 31, 2005. The present invention relates to massage devices for massaging the body, the face, and/or the scalp.

BACKGROUND

U.S. Pat. No. 5,218,955 discloses a massage device for massaging the skin, the device including two rotary massage members at one end of a handle.

US application No. 2005/0020948 discloses a massage device in which the massage member(s) is/are mounted on a receptacle containing a composition for application.

GB 261 902 discloses a device for beating the skin, the device including balls mounted at the end of elastically deformable stems.

U.S. Pat. No. 2,691,978 describes a massage device including a handle formed by a U-shaped stem forming two branches supporting rotary massage members. The user can move the branches together by hand.

FR 2 282 855 describes a device including two branches that pivot about a common axis.

SUMMARY

There exists a need to benefit from a massage device that is suitable for the body or for the face, for example.

There also exists a need to benefit from a massage device that makes it possible to perform lymphatic drainage, for example.

In one of its aspects, the invention provides a massage device comprising:

at least two massage members;

at least two branches, each carrying at least one massage member, the branches being in a first configuration when the massage members are not engaged with the region to be treated, and being capable of taking up a second configuration when the massage members are engaged with the region to be treated, the branches being displaced relative to each other while passing from the first configuration to the second, and being capable of returning resiliently into the first configuration when the massage members are no longer engaged with the region to be treated.

The branches may be elastically deformable along at least two axes, and they may present a cross-section that is not circular over at least a fraction of their length.

The branches may present varying width and/or thickness.

Such a non-circular section makes it possible to create at least one preferred direction of deformation for the branch, and makes it possible to control the deformation of the branch during use.

The displacement of the branches can enable the device to adapt to the various outlines of the body or of the face, thereby improving the effectiveness of the treatment and/or comfort in use.

In an embodiment of the invention, at least one of the massage members is a rotary massage member. By way of example, all the massage members may be rotary massage members.

By way of example, the deformation at the end of the branches may exceed 3 millimeters (mm), depending on the flexibility of said branches, with other values being possible.

In an embodiment of the invention, the branches are connected to a handle. By way of example, the handle may comprise another massage member at an end that is remote from the branches. This other massage member may optionally be a rotary massage member, and it may comprise portions in relief, e.g. spikes. The branches may be made integrally with the handle by molding.

The branches may be configured so as to deform by moving apart while the massage device is being used on the skin. Thus, the extent to which the branches can deform by moving towards each other may be very limited, indeed it may be practically non-existent, e.g. not greater than 5 mm, better not greater than 3 mm, better still not greater than 1 mm.

When each branch comprises at least one rotary massage member, the axes of rotation of the massage members may form an angle that is less than 180°, for example, or, in a variant, that is greater than 180°.

The presence of an angle between the axes of rotation of the massage members makes it possible to exert a plissé-roulé effect on the skin.

In an embodiment of the invention, the branches are connected to a support enabling them to be removably fastened on a receptacle that contains a composition for application prior to, during, or after massaging, for example. The branches may also be connected to the receptacle.

Where appropriate, the receptacle may comprise a dispenser member, e.g. a pump or a valve, or merely a dispenser orifice that is suitable for being closed by a closure cap that is mounted to pivot on the receptacle, for example.

The massage device may comprise a protective cap for covering the branches while the device is not in use.

The branches may present respective longitudinal axes that are curvilinear.

The handle may present a generally flat shape.

The handle may present a curved shape when observed from the side, with the longitudinal axes of the branches being superposed.

The handle may be curved about an axis of curvature that is parallel to a long side of the section of the handle.

When the massage device comprises a plurality of rotary massage members, the axes of rotation of the massage members need not be coplanar, thereby making it easier to massage certain regions of the body or of the face, for example.

The massage member(s) may possibly be mounted on one or more swivel forks, so as to be capable of swiveling relative to the branches. This makes it possible for the massage members to be oriented during use as a function of the displacement of the massage device over the skin, for example.

The massage members may be arranged relative to the branches in such a manner that the massage members move towards each other while the device is being displaced in a first direction over the region being treated, and move away from each other while the device is being displaced in a second direction, opposite from the first.

The branches may be arranged so as to be fastened about a receptacle. By way of example, the branches may be connected together to form a loop, and the receptacle may include a groove in which the loop can be received, for example.

In another of its aspects, the invention also provides a kit comprising:

a receptacle;

a massage device comprising:

two branches; and a loop-shaped portion connecting together the branches, the portion being elastically deformable, and being suitable for being fastened in removable manner on the receptacle.

In another of its aspects, the invention also provides a massage method in which a massage device as defined above is applied to the skin, and in which the branches deform in contact with the skin.

BRIEF DESCRIPTION OF THE DRAWINGS

The invention can be better understood on reading the following detailed description of non-limiting embodiments thereof, and on examining the accompanying drawings, in which.

DETAILED DESCRIPTION OF EMBODIMENTS

Figure 1:
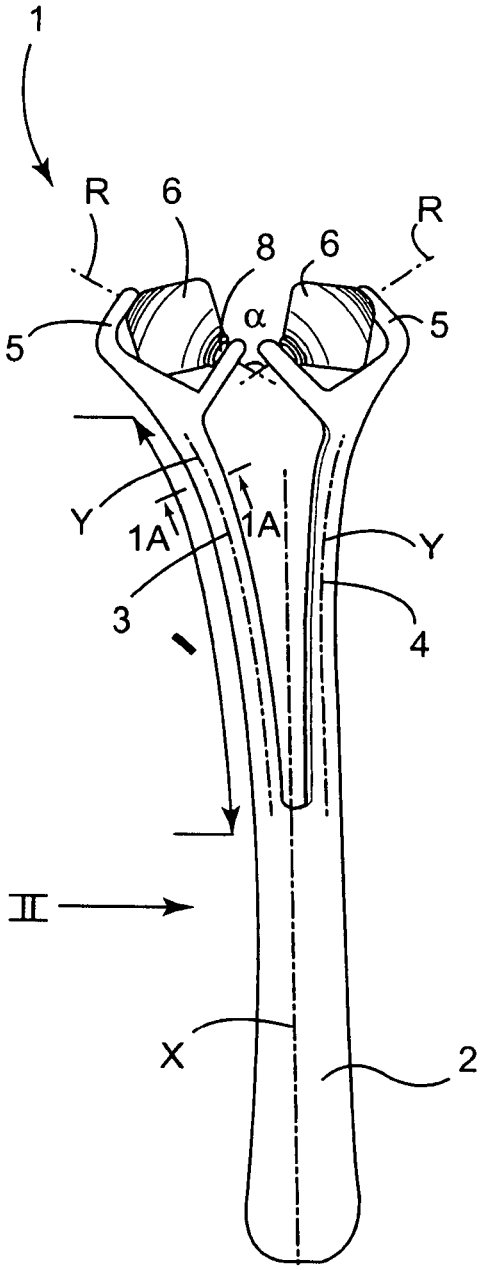
FIG. 1 is an elevation view of an example of a massage device made in accordance with the invention.
Figure 2:
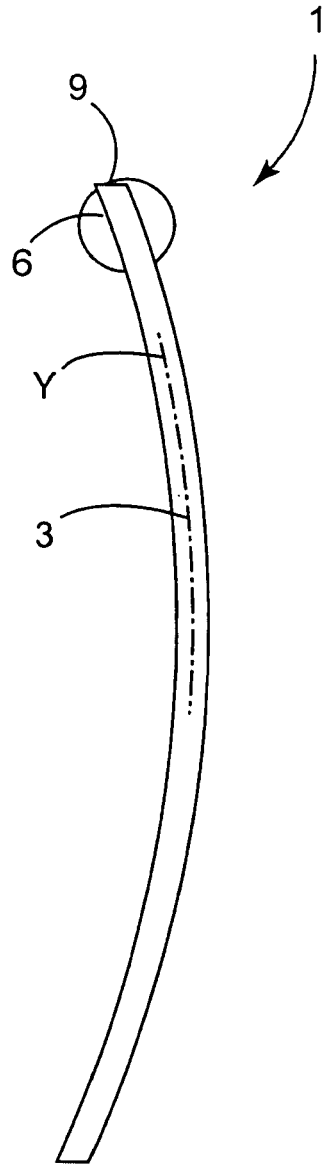
FIG. 2 is a side view as seen looking along II of FIG. 1.

FIGS. 1 and 2 show a massage device 1 comprising a handle 2 of longitudinal axis X, and two branches 3 and 4, each provided at its end with a fork 5 in which a rotary massage member 6 turns about an axis of rotation R.

In FIGS. 1 and 2, the massage device 1 is shown in a first or rest configuration.

In the embodiment under consideration, the axes of rotation R form between them an angle $\alpha$ that is less than 180°, e.g. lying in the range 90° to 120°.

The handle 2 presents a generally curved shape, as can be seen in FIG. 2, and each of the branches 3 and 4 extends along a longitudinal axis Y that is curvilinear.

The length l of a branch between the junction with the handle 2 and the corresponding fork 5 is not less than 40 mm, for example.

Figure 3:
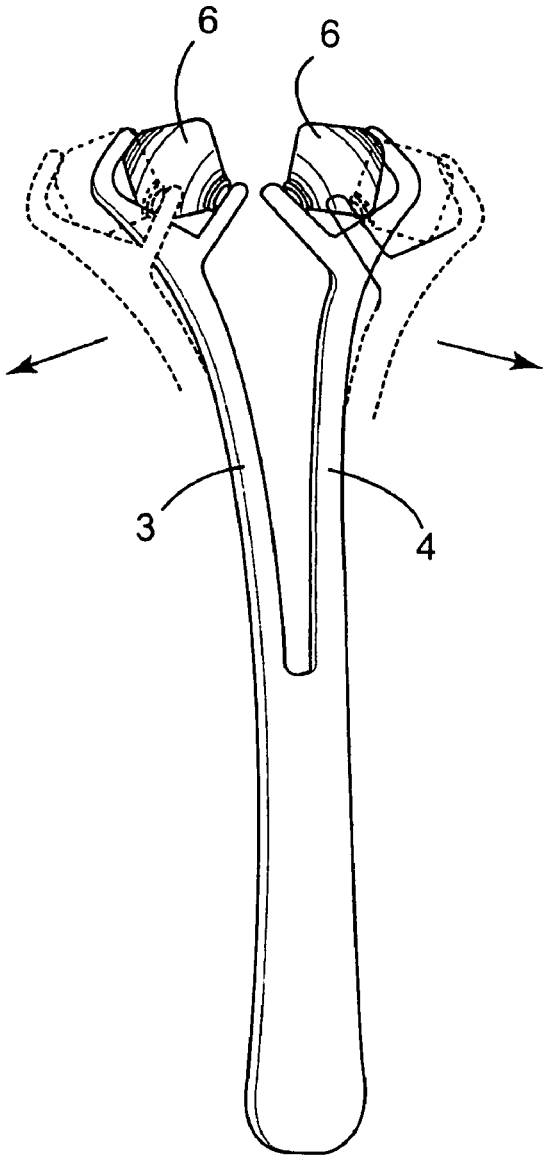
FIGS. 3 and 4 are views similar to FIGS. 1 and 2 respectively, showing the displacement of the branches.
Figure 4:
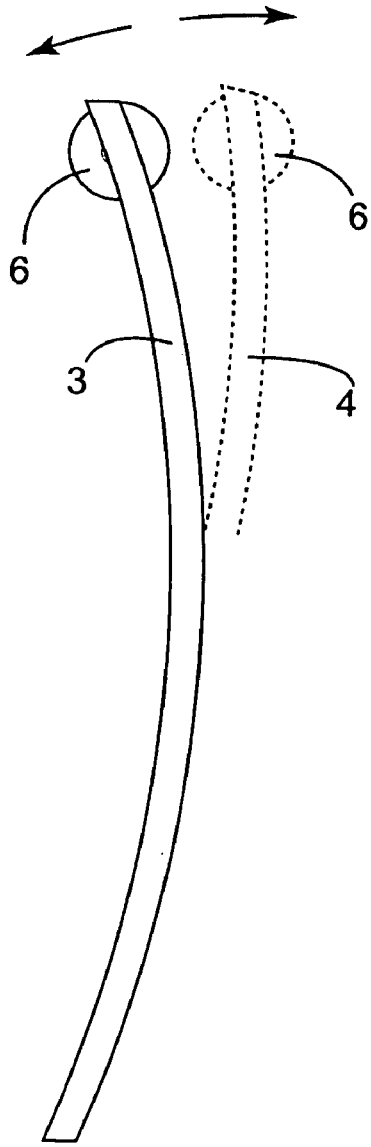

By way of example, the length l is selected as a function of the material from which the branches are made, such that said branches present a certain flexibility, and may deform while the massage members 6 are rolling over the skin, e.g. by moving apart substantially in their plane, so as to take on a second configuration, as shown in FIG. 3, and/or by moving apart substantially in a plane that is perpendicular, so as to take on a second configuration, as shown in FIG. 4.

The branches can thus deform about a plurality of axes, e.g. one or more axes that are substantially perpendicular to the plane of FIG. 3 and/or to the plane of FIG. 4.

The direction in which the branches deform may possibly depend on the orientation of the massage members and on the direction in which said massage members are displaced over the skin.

Where appropriate, the massage members may be touching once the branches have been deformed and/or once they have been displaced relative to each other.

The length and the shape of the branches 3 and 4 could also be selected as a function of the desired handling ergonomics.

Over at least a portion of its length, each branch 3 or 4 may present a cross-section that is not circular, so as to impart to the branch at least one preferred direction of deformation.

There is no need for any of the cross-sections of any of the branches to be circular.

Figure 1A:
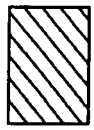
FIG. 1A is a cross-section on 1A-1A of FIG. 1.

By way of example, each branch can present a cross-section that is not circularly symmetrical, e.g. a cross-section of generally rectangular shape, as shown in FIG. 1A, e.g. with its long side substantially perpendicular to the flat of the handle when the device is observed from above, as in FIG. 1.

In the embodiment under consideration, the branches 3 and 4 and the forks 5 are made as a single part by molding a plastics material, e.g. a polyolefin. Each massage member 6 is mounted on the corresponding fork 5 by means of a pin 8 which is an insert that is held at its ends in corresponding housings 9.

The branches 3 and 4 can also be made integrally with the handle 2 by molding a plastics material.

By way of example, the pin 8 is made integrally with the massage member, or else it is made separately.

In the embodiment shown, each massage member 6 is carried solely by the corresponding branch 3 or 4.

Figure 5:
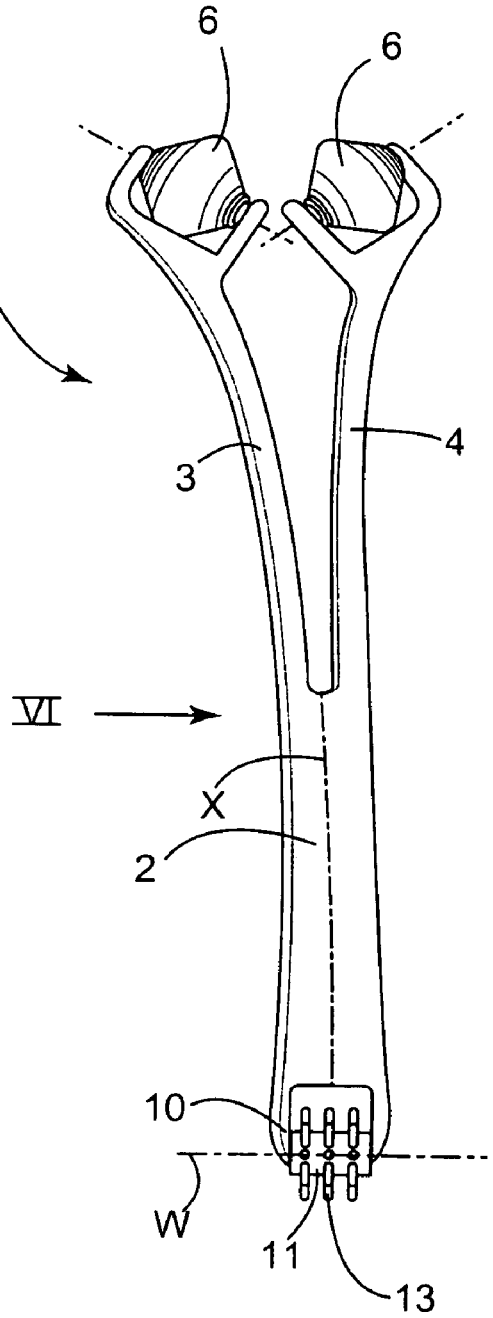
FIG. 5 is an elevation view of a variant embodiment.
Figure 6:
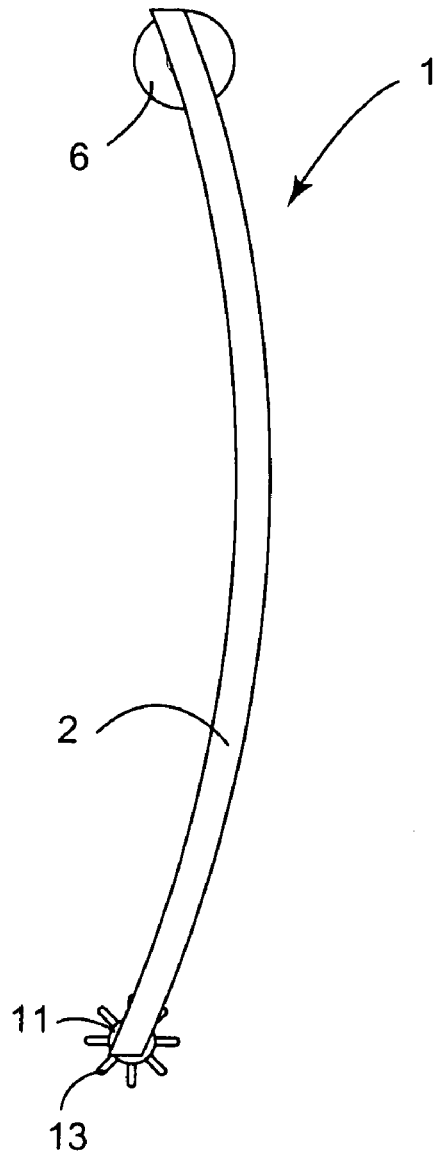
FIG. 6 is a side view as seen looking along arrow VI of FIG. 5.

The massage device 1 shown in FIGS. 5 and 6 differs from the massage device of FIGS. 1 and 2 by the end 10 of the handle 2 that is remote from the branches 3 and 4 carrying another massage member 11 that turns about an axis of rotation W that is perpendicular to the longitudinal axis X of the handle 2, for example.

By way of example, the massage member 11 comprises spikes 13, thereby making it possible to perform a treatment that is similar to acupuncture while it is being displaced over the skin.

Figure 7:
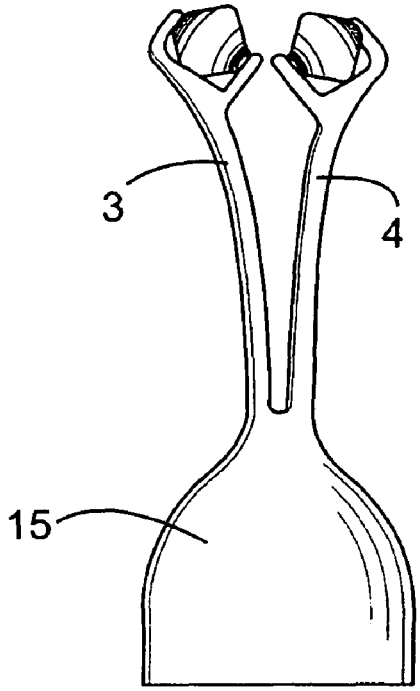
FIGS. 7 and 8 are exploded views of variant embodiments of the invention.
Figure 7:
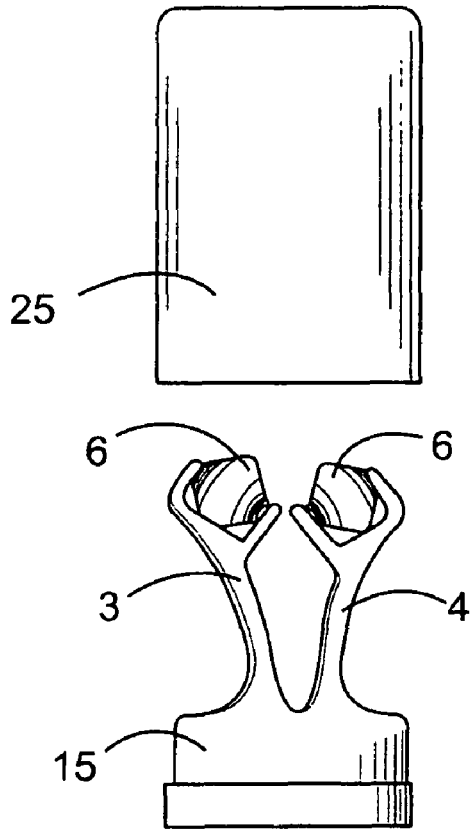
Figure 7:
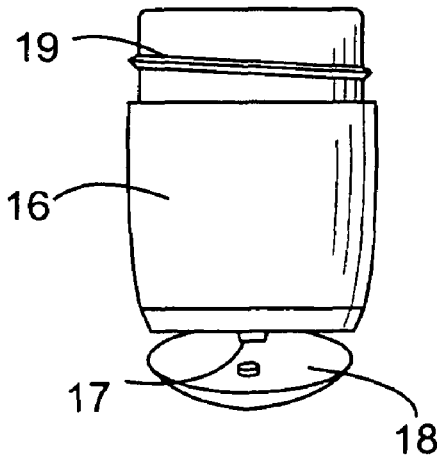
Figure 8:
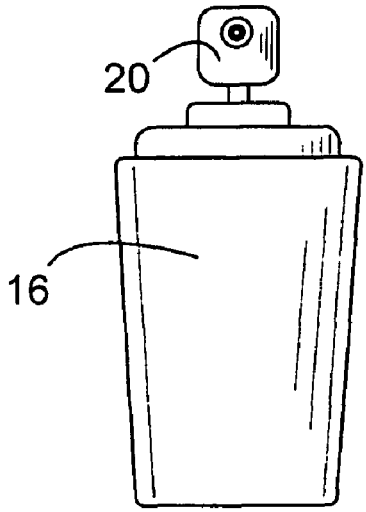

The branches 3 and 4 can be connected to a handle, or, as shown in FIGS. 7 and 8, they can be connected to a common support 15 for fastening on a receptacle 16.

In the FIG. 7 embodiment, on the side remote from the support 15, the receptacle comprises a dispenser orifice 17 and a closure cap 18 making it possible to close the dispenser orifice 17 while the device is not in use.

By way of example, the receptacle 16 has a flexible wall, and the composition is dispensed by squeezing its wall, for example.

In the embodiment in FIG. 8, the receptacle 16 is provided with a dispenser member 20 that is a pump or a valve, for example.

The support 15 can be arranged so as to cover the dispenser member 20, and can itself receive a protective cap 25 that comes to cover the branches 3 and 4.

By way of example, the support 15 is fastened by snap-fastening on the receptacle 16, said receptacle comprising, for this purpose, a portion in relief 19, for example.

Figure 9:
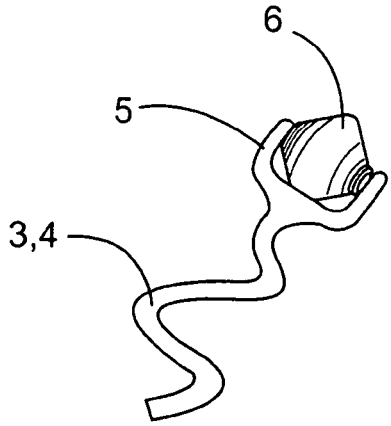
FIG. 9 shows a variant of a branch and its associated massage member.

The branches 3 and 4 can be of various shapes, e.g. an undulated shape, as shown in FIG. 9, so as to impart greater flexibility thereto, for example.

Figure 10:
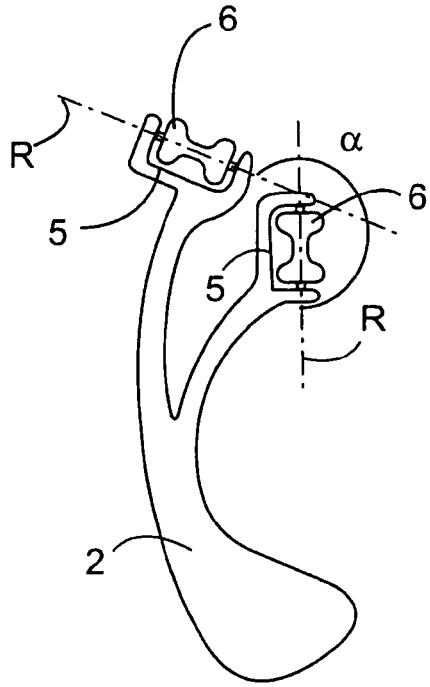
FIG. 10 is an elevation view of a variant embodiment of the invention.

The axes of rotation of the massage members 6 can have various orientations, and the angle between the axes can be greater than 180°, for example, as shown in FIG. 10.

Figure 11:
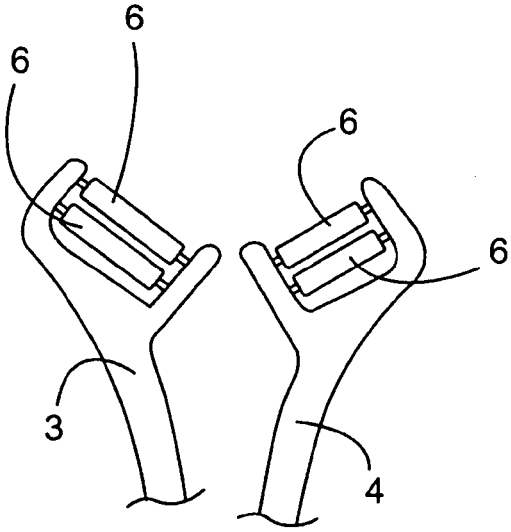
FIG. 11 shows branches in isolation, each including a plurality of massage members.
Figure 12:
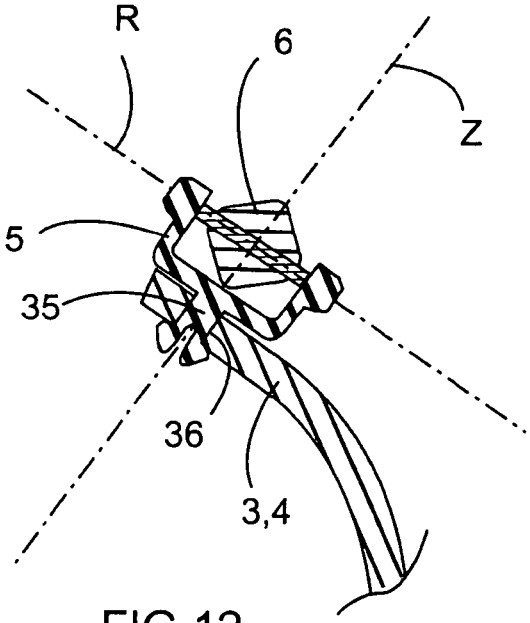
FIG. 12 shows how a massage member is assembled on a swivel fork.

Each branch 3 or 4 can carry a plurality of massage members 6, as shown in FIG. 11. In this embodiment, each branch 3 or 4 carries two rotary massage members 6.

At least one massage member 6 can be rotatably mounted on a fork 5 that is itself swivel-mounted about a swivel axis Z, so as to be capable of swiveling relative to the corresponding branch 3 or 4.

By way of example, the fork 5 can be made integrally with a stub pin 35 that is snap-fastened in a corresponding hole 36 of the branch. By way of example, the axes R and Z are substantially perpendicular, as shown.

Figure 13:
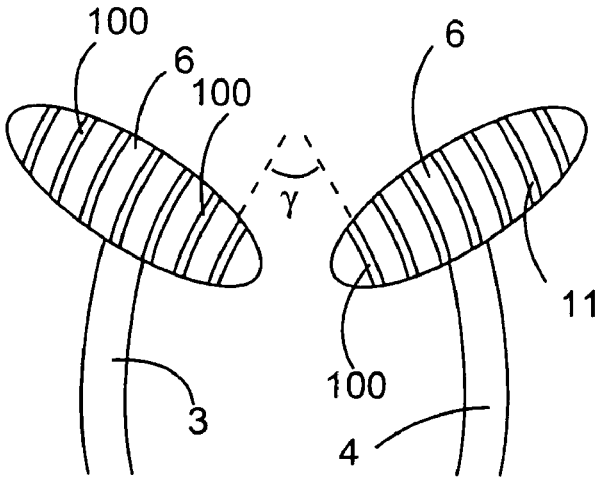
FIG. 13 shows a variant of a massage device.

In the embodiment in FIG. 13, the massage members 6 are fastened in non-rotary manner to the ends of the branches 3 and 4.

By way of example, the massage members 6 are in the form of shoes provided with flexible blades 100 that are capable of flexing when the shoes 6 are displaced in contact with the skin.

By way of example, the blades 100 are parallel to one another, the blades 100 of one of the massage members forming an acute angle γ relative to the blades of the other massage member.

By way of example, the blades 100 are molded integrally with the remainder of the shoes from elastomer material.

The deformation of the blades 100 can make it easier for the shoes to slide over the skin.

Figure 14:
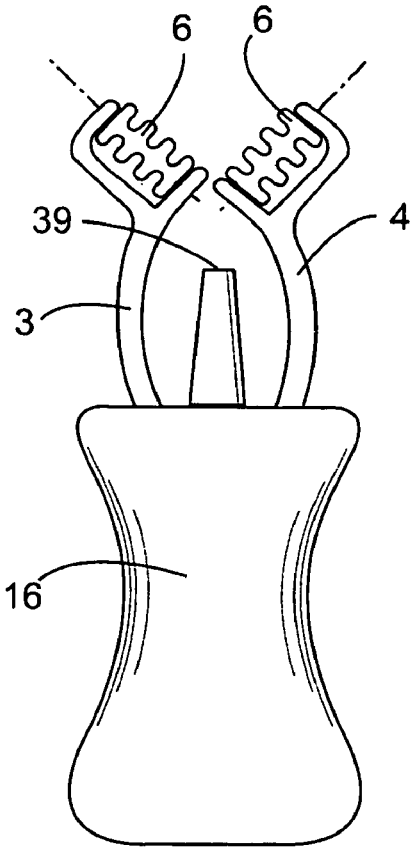
FIG. 14 is an elevation view of a massage device in which the branches are secured to a receptacle.

The branches 3 and 4 can be secured to a receptacle 16 that comprises a dispenser endpiece 39, thereby making it possible to dispense the composition contained in said dispenser endpiece in the proximity of the massage members 6, as shown in FIG. 14.

Figure 15:
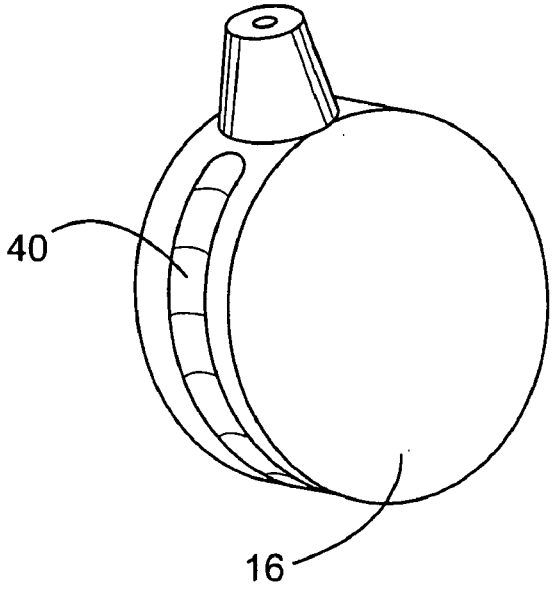
FIG. 15 shows a receptacle in isolation, arranged so as to receive a massage device.
Figure 16:
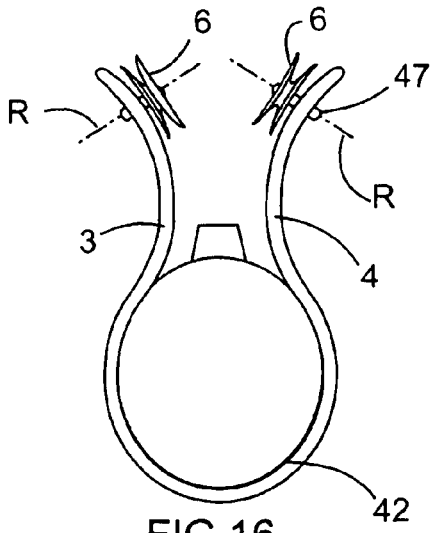
FIG. 16 shows the FIG. 15 receptacle with a corresponding massage device in place.
Figure 17:
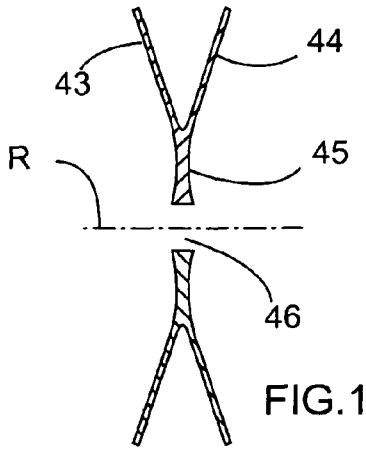
FIG. 17 is an axial section of a massage member.

FIG. 15 shows a receptacle 16 that comprises a groove 40 at its periphery for receiving a loop-shaped portion 42 connecting together the branches 3 and 4, as shown in FIG. 16.

In this figure, it can be seen that each of the massage members 6 may comprise two flexible lips 43 and 44 that are made of elastomer, for example, integrally with a central portion 45 that has an opening 46 passing therethrough, and through which there can pass a pin 47 that is held to the corresponding branch.

Figure 18:
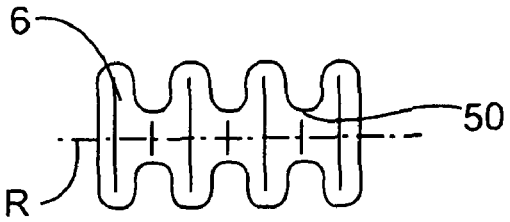
FIGS. 18, 19, 23 and 24 are face views showing other examples of massage members.
Figure 19:
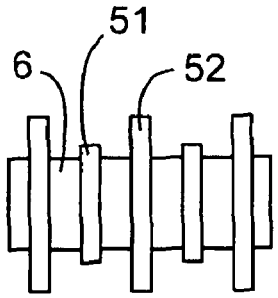

The massage device can be provided with a very wide variety of massage members, e.g. in the form of rollers having a surface that is optionally circularly cylindrical, and that comprises undulations 50, for example, as shown in FIG. 18.

Figure 20:
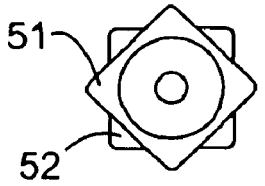
FIG. 20 is a side view of the FIG. 19 massage member.
Figure 21:
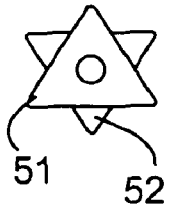
FIGS. 21 and 22 are views similar to FIG. 20 showing variant embodiments.

A massage member 6 may comprise a roller with projecting ribs 51 and 52, e.g. ribs having an outline that is polygonal, e.g. square, as shown in FIG. 20, or triangular, as shown in FIG. 21. Two adjacent ribs 51 and 52 can be offset angularly relative to each other.

Figure 23:
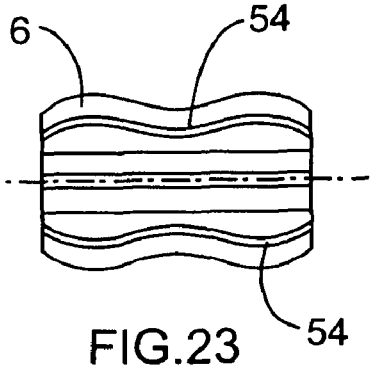
Figure 22:
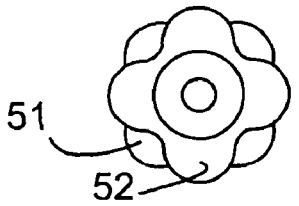

A massage member 6 may also comprise longitudinal splines 54, as shown in FIG. 23, that may present an undulated shape, where appropriate.

Figure 24:
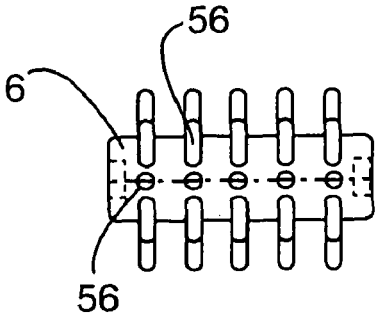
Figure 25:
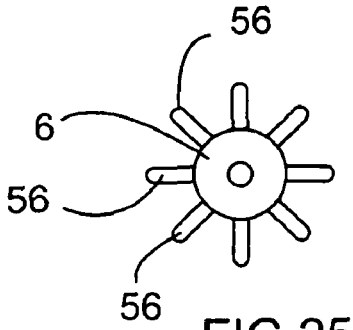
FIG. 25 is a side view of the FIG. 24 massage member.

As shown in FIGS. 24 and 25, a massage member 6 may also comprise a plurality of projecting elements 56, such as spikes, that are optionally identical, and that are distributed in optionally uniform manner over the outer surface of the massage member, for example.

Figure 26:
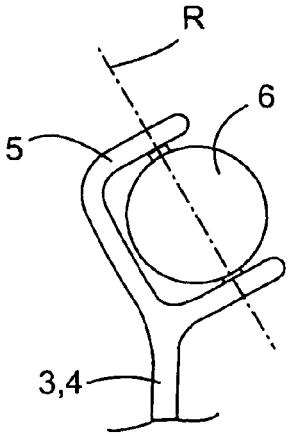
FIG. 26 shows a branch in isolation, provided with a spherical massage member.
Figure 27:
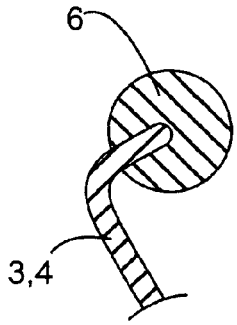
FIG. 27 is a longitudinal section showing a branch including a stationary massage member.
Figure 28:
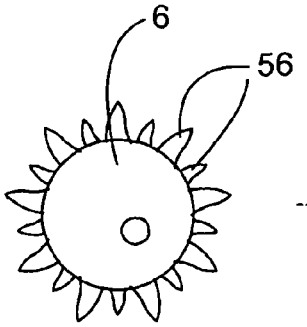
FIG. 28 shows the possibility of making a rotary massage member with an axis of rotation that is off-center.
Figure 29:
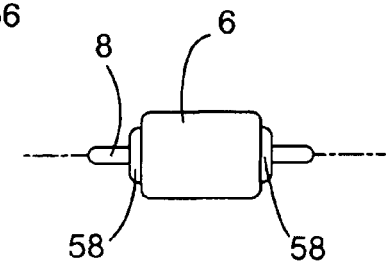
FIG. 29 shows the possibility of making the rotary massage member with cheek plates.

FIG. 26 shows the possibility of the massage member presenting a substantially spherical shape.

Where appropriate, the massage member 6 need not be rotatable, but could be stationary relative to the branch 3 or 4 that carries it, as shown in FIG. 27. When the massage member is a rotary massage member, it may turn about an axis of rotation that is off -center, as shown in FIG. 28. This figure also shows projecting elements 56 that are not identical.

The massage member 6 can be situated between cheek plates 58 that can make it easier to turn. By way of example, the cheek plates 58 are made integrally with a pin 8 by molding a plastics material.

The axes of rotation R of the massage members 6 can optionally be coplanar.

Figure 30:
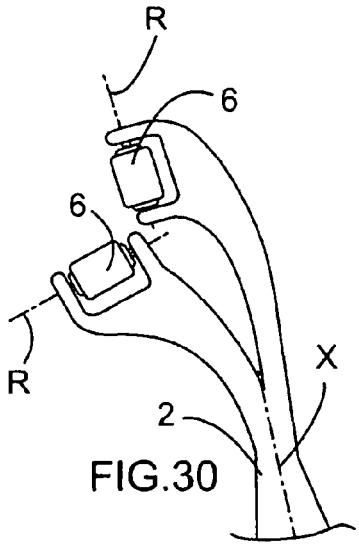
FIG. 30 is a diagram of a massage device in which the axes of rotation of the massage members extend in a plane that is substantially perpendicular to the longitudinal axis of the handle.

In the embodiment in FIG. 30, the axes of rotation R are coplanar in a plane that is substantially perpendicular to the longitudinal axis X of the handle 2.

Naturally, the invention is not limited to the embodiments described above.

For example, all the massage devices shown may thus be provided with any massage member 6, and the device of FIGS. 1 and 2 can, for example, comprise massage members other than the massage members shown, e.g. it may comprise any one of the massage members shown in FIGS. 17 to 29.

The angles between the axes of rotation of the massage members may be d

The massage device may comprise massage members that are different from each other.

The characteristics of the various embodiments shown may be combined together within variants not shown.

The expression "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A massage device comprising:

at least two rotary massage members having axes of rotation that are non-parallel; and a handle which includes a first part that is less deformable than a second part and that is located at an end opposite from the at least two rotary massage members and the second part separates into at least two branches at a point approaching the at least two rotary massage members, each of the branches of the second part being configured to be elastically deformable along at least two axes with respect to the first part, and each of the branches of the second part carrying at least one of the at least two rotary massage members, the branches being in a first configuration when the at least two rotary massage members are not engaged with the region to be treated, and being configured to assume a second configuration when the massage members are engaged with the region to be treated, the branches being displaced relative to each other in one of the at least two axes while passing from the first configuration to the second configuration and being configured to return resiliently to the first configuration when the at least two rotary massage members are no longer engaged with the region to be treated, the branches presenting a cross-section that is not circular over at least a fraction of their length, wherein the massage members are arranged relative to the branches in such a manner that the massage members move towards each other while the device is being displaced in a first direction over the region being treated, and move away from each other while the device is being displaced in a second direction, opposite from the first.

2. A device according to claim 1, wherein at least two of the at least two rotary massage members are identical.

3. A device according to claim 1, wherein the handle comprises a massage member at an end that is remote from the branches.

4. A device according to claim 1, wherein the branches are flexible enough to deform while the massage members are being applied to the skin.

5. A device according to claim 1, wherein the axes of rotation of the massage members form an angle that is less than 180° .

6. A device according to claim 1, wherein the axes of rotation of the massage members form an angle that is greater than 180° .

7. A device according to claim 1, wherein the handle is a support enabling to be removably fastened on a receptacle.

8. A device according to claim 7, wherein the receptacle comprises a dispenser member.

9. A device according to claim 8, comprising a cap for covering the branches while the dispenser is not in use.

10. A device according to claim 1, each of the branches presenting a longitudinal axis that is curvilinear.

11. A device according to claim 1, further comprising at least one massage member mounted on a swivel fork.

12. A device according to claim 1, wherein at least one of the branches presents a length that is not less than 40 mm.

13. A device according to claim 1, the first part of the handle presenting a generally flat shape.

14. A device according to claim 1, the handle presenting a curved shape when observed from the side, with the longitudinal axes of the branches being superposed.

15. A device according to claim 1, the handle presenting a generally flat shape that is curved when observed from the side, with the longitudinal axes of the branches being superposed, the handle being curved about an axis of curvature that is parallel to a long side of the handle.

16. A massage method wherein a massage device as defined in claim 1 is applied to the skin, and wherein the branches deform in contact with the skin by moving apart.

* * * * *